US007345567B2

(12) United States Patent
Fujii et al.

(10) Patent No.: US 7,345,567 B2
(45) Date of Patent: Mar. 18, 2008

(54) INVERTER TRANSFORMER

(75) Inventors: Akihiro Fujii, Shizuoka (JP); Toru Hirohashi, Shizuoka (JP); Nobuaki Ito, Shizuoka (JP); Kiyoshi Hironaka, Shizuoka (JP); Katsuo Yamada, Shizuoka (JP); Akihiro Sudo, Aichi (JP); Kenichiro Suzuki, Shizuoka (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 11/809,924

(22) Filed: Jun. 1, 2007

(65) Prior Publication Data

US 2007/0247267 A1 Oct. 25, 2007

Related U.S. Application Data

(63) Continuation of application No. PCT/JP2005/021966, filed on Nov. 30, 2005.

(30) Foreign Application Priority Data

Dec. 2, 2004 (JP) ..... 2004-350323

(51) Int. Cl.
*H01F 27/24* (2006.01)

(52) U.S. Cl. ..... 336/212; 336/178; 336/208

(58) Field of Classification Search ..... 336/208, 336/212, 198, 192
See application file for complete search history.

(56) References Cited

U.S. PATENT DOCUMENTS 5,359,313 A * 10/1994 Watanabe et al. ..... 336/178
6,982,623 B2 * 1/2006 Satou et al. ..... 336/178
2002/0176268 A1 * 11/2002 Suzuki ..... 363/97

FOREIGN PATENT DOCUMENTS

| | | | |
|---|---|---|---|
| JP | 54-76967 | | 6/1979 |
| JP | 02-146815 | | 12/1990 |
| JP | H07-022528 | | 1/1995 |
| JP | 08-227815 | | 9/1996 |
| JP | 11329864 | A * | 11/1999 |
| JP | 2000133531 | A * | 5/2000 |

* cited by examiner

*Primary Examiner*—Anh Mai
(74) *Attorney, Agent, or Firm*—Harness, Dickey & Pierce, PLC

(57) ABSTRACT

Variation in inductance and leakage inductance between the secondary windings is reduced thereby making lamp currents uniform and thus preventing the occurrence of uneven brightness. A two-output inverter transformer comprises a bobbin having a primary winding wound around the middle and secondary windings wound on both sides thereof and having a pole-like core inserted into its winding shaft. A rectangle frame-like core is placed to surround the primary and secondary windings such that the pole-like core is opposite the rectangle frame-like core with a gap sheet interposed at either end. Their sizes are set such that L2−L1>2 t, where L1 is the length of the rectangle frame-like core, L2 is the length of the pole-like core, and t is the thickness of the gap sheet, and they are so combined that the pole-like core protrudes evenly from the opposite ends of the rectangle frame-like core.

4 Claims, 5 Drawing Sheets

INVERTER TRANSFORMER

CROSS-REFERENCE TO RELATED APPLICATIONS

The present application is a continuation-in-part of International Application PCT/JP2005/021966, with an international filing date of Nov. 30, 2005, which is herein incorporated by reference. The present application claims priority from Japanese Patent Application No. 2004-350323 filed on Dec. 2, 2004, which is herein incorporated by reference.

BACKGROUND OF THE INVENTION

1. Field of the Invention

The present invention relates to a two-output inverter transformer having a primary winding located in the middle and secondary windings located on both sides thereof, and more specifically to an inverter transformer having variation in inductance between the secondary windings reduced by devices applied to the sizes and positional relationship of a pole-like core and a rectangle frame-like core forming a magnetic path. This inverter transformer is useful for the back light of a liquid crystal display apparatus, for example.

2. Related Art

For a back light for liquid crystal television sets or liquid crystal displays, a plurality of cold cathode tubes are used. For example, 32-inch liquid crystal television sets have 16 cold cathode tubes arranged at appropriate intervals on their back, thus keeping the brightness of their entire screen. When a plurality of cold cathode tubes are turned on, in order to suppress variation in brightness between the cold cathode tubes to achieve even illumination, the lamp currents of the individual cold cathode tubes need to be kept uniform. If each cold cathode tube is driven by a transformer independently, variation in brightness will be easily suppressed. However, because the drive circuit becomes complex, it is inefficient. Accordingly, it has been proposed that two cold cathode tubes are configured to be driven by one transformer, thereby reducing the number of the components and the size of the entire inverter circuit thus lowering costs.

A transformer for back-light having two outputs on the secondary side of its high-voltage transformer is described in, for example, Japanese Utility Model Application Publication No. H07-22528. Usually, an inverter transformer and a drive circuit are integrated into a unit, and the placement of the unit as a cold cathode tube turning-on circuit is repeated on the back and sides of a set of cold cathode tubes a number of times according to the size of a liquid crystal panel (or the number of cold cathode tubes arranged), and the units are wired to the cold cathode tubes as needed, thereby producing a liquid crystal panel.

As to liquid crystal television sets or liquid crystal displays, the brightness of the screen is becoming increasingly high, and correspondingly variation in brightness between the plurality of cold cathode tubes is becoming a bigger problem. In particular, when a two-output inverter transformer is used for a reduced size and lowered cost, because inductance variation between the two secondary windings (output windings) would cause variation in lamp current, the inductance variation needs to be suppressed.

Accordingly, in Japanese Utility Model Application Publication No. H07-22528, a bobbin, cores, a gap sheet, and the like are configured to be mirror-symmetrical with respect to the center, thereby reducing inductance variation between the two secondary windings. However, there are the problem in assembly that two C-shaped cores and an I-shaped core are put together to touch each other and fixed and the problem that the size tolerance of the C-shaped cores and I-shaped core causes a difference in gap size and thus the inductance variation between the two secondary windings cannot be reduced enough.

Meanwhile, a technique has been proposed in which a magnetic path is formed by a pole-like core and a rectangle frame-like core, but while the gap size can be strictly controlled with use of a gap sheet, the inductance variation between the two secondary windings cannot be reduced enough.

Furthermore, because one liquid crystal panel uses a plurality of inverter transformers, in order to reduce the unevenness of brightness, variation in inductance between the secondary windings of the inverter transformers needs to be suppressed when mass-produced. However, in an actual mass-production process, because of the accuracy of the core sizes, positional deviations of the cores when combined, variation in the state of winding, and the like, variation in inductance is inevitable.

SUMMARY OF THE INVENTION

An object of the present invention is to provide a two-output inverter transformer wherein variation in inductance and leakage inductance between the secondary windings is reduced thereby making lamp currents uniform and thus preventing the occurrence of uneven brightness. Another object thereof is to make variation in inductance between the secondary windings of multiple inverter transformers as small as possible which would otherwise occur when mass-produced.

According to one aspect of the present invention, there is provided a two-output inverter transformer comprising a bobbin that has a winding shaft; an end block provided at either end of the winding shaft; two intermediate blocks spaced apart on the middle of the winding shaft; a portion between the two intermediate blocks around which a primary winding is wound; and portions on both sides of the primary winding portion between the intermediate block and the end block around which secondary windings of the same winding structure are wound respectively; a pole-like core inserted into the winding shaft; a rectangle frame-like core combined with the pole-like core and placed to surround the primary winding and the secondary windings; and gap sheets of the same thickness interposed between the pole-like core and the rectangle frame-like core at both ends of the bobbin respectively. L1, L2, and t are set such that $L2-L1>2t$, where L1 is the length along the winding shaft of the rectangle frame-like core, L2 is the length of the pole-like core, and t is the thickness of the gap sheet, and the pole-like core and the rectangle frame-like core are so combined that the pole-like core protrudes evenly from the opposite end faces of the rectangle frame-like core.

The bobbin further has an insulating flange provided on the inner face of each of the end blocks facing one of the secondary winding portions. The intermediate blocks each function as a flange. The secondary winding portions are each provided with a plurality of sub-flanges around which the secondary winding is wound dividedly, and terminals to which the ends of the windings are connected are fixed to two or more of the blocks. The bobbin is integrally formed of electrically insulating resin.

Preferably by winding insulating tape around the primary winding wound around the primary winding portion, the bobbin and the rectangle frame-like core aligned with each other are attached on a temporary basis. By this means, the pole-like core and the rectangle frame-like core can be combined easily and accurately. Further, the upper surface of the transformer is smooth with the insulating tape and thus can be used as a sucking-attachment surface in mounting the transformer.

Pull-out grooves for the secondary windings and a protrusion to secure a path through which the wire of the primary winding passes are preferably formed in and on one or more of the blocks (the end blocks and the intermediate blocks) of the bobbin. With these, the windings are fixed in place, thereby preventing the windings from deviating. Hence, variation in inductance between the secondary windings is further suppressed.

In the inverter transformer according to an aspect of the present invention, the length of the pole-like core is set to be greater than the length along the winding shaft of the rectangle frame-like core by greater than twice the thickness of the gap sheet, and the pole-like core and the rectangle frame-like core are so combined that the pole-like core protrudes evenly from the opposite end faces of the rectangle frame-like core. Hence, variation in inductance between the secondary windings can be reduced. Moreover, even if a slight positional deviation occurs when the pole-like core and the rectangle frame-like core are combined in mass-production, variation in inductance between the secondary windings will be smaller. Therefore, the lamp currents of a plurality of cold cathode tubes arranged become uniform, thereby preventing unevenness in their brightness from occurring.

<Explannation of Reference Numerals>

10 Bobbin, 12 Primary winding, 14 Secondary winding, 16 Pole-like core, 18 Rectangle frame-like core, 20 Gap sheet

DETAILED DESCRIPTION OF THE INVENTION

A two-output inverter transformer comprises a bobbin having an end block at either end of a winding shaft, two intermediate blocks spaced apart on the middle, a portion for a primary winding between the two intermediate blocks, and portions on both sides thereof between the intermediate block and the end block for secondary windings of the same winding structure respectively; a pole-like core inserted into the winding shaft; and a rectangle frame-like core combined with the pole-like core and placed to surround the primary winding and the secondary windings, and is so structured that the pole-like core is opposite the rectangle frame-like core with a gap sheet of the same thickness interposed therebetween at either end of the bobbin. It is a conventional technological wisdom that for such a two-output inverter transformer, the cores are designed to have such sizes that L2=L1, where L1 is the length along the winding shaft of the rectangle frame-like core and L2 is the length of the pole-like core.

However, the present inventors conducted research without letting that technological wisdom bind them. As a result, it was found that when the length L2 of the pole-like core is made greater than the length L1 of the rectangle frame-like core so that the pole-like core protrudes a certain size or greater from the rectangle frame-like core at both ends, the rate (or gradient) at which inductance varies with the protrusion amount becomes smaller, so that variation in inductance due to variation in core size, relative position deviation when combined, or the like is greatly reduced. As a result of further examination, it was found that an inflection point of inductance variation with the protrusion amount is located at L2−L1=2 t, where t is the thickness of the gap sheet.

The present invention was made based on the understanding of this phenomenon. That is, according to the present invention, there is provided an inverter transformer having the sizes of the cores set such that L2−L1>2 t and assembled such that the pole-like core protrudes evenly from either end face of the rectangle frame-like core. Near L2=L1, when mass-produced, a large difference in inductance occurs due to a slight difference in size, positional deviation when both the cores are combined, or the like, but where the core sizes are set such that L2−L1>2 t and it is assembled such that the pole-like core protrudes evenly, even if a slight positional deviation occurs when both the cores are combined in mass-production, the difference in inductance is extremely small.

Figure 1A:
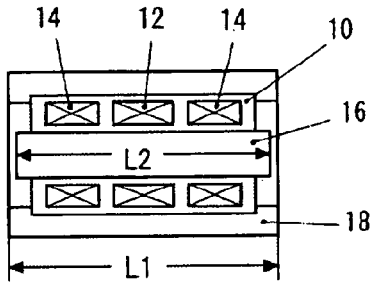
FIG. 1A is a plan view of an inverter transformer used in a simulation.
Figure 1B:
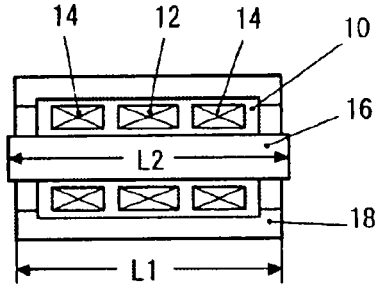
FIG. 1B is a plan view of another inverter transformer used in a simulation.
Figure 1C:
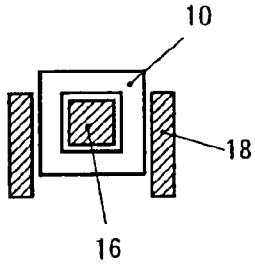
FIG. 1C is a sectional view of the inverter transformer of FIG. 1A used in the simulation.
Figure 1D:
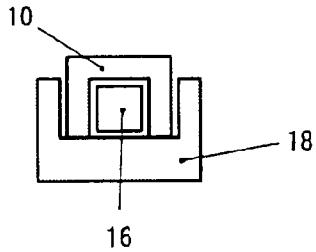
FIG. 1D is a side view of the inverter transformer.
Figure 2:
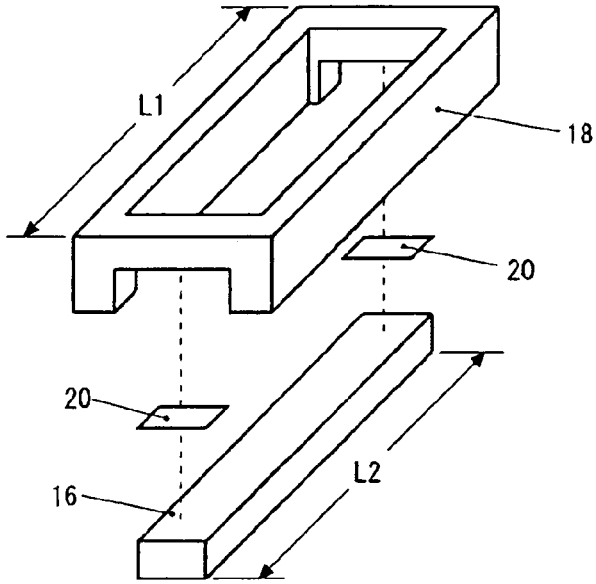
FIG. 2 is a perspective view of a pole-like core and a rectangle frame-like core.

The shape of a transformer on which a simulation is performed and the simulation results will be shown. FIG. 1 shows the configuration of an inverter transformer used in the simulation. FIG. 1A and FIG. 1B are plan views; FIG. 1C is a sectional view; and FIG. 1D is a side view. FIG. 2 shows the shapes of the cores. A primary winding 12 is wound around the middle of the winding shaft of the bobbin 10, and secondary windings 14 of the same winding structure are wound on both sides thereof respectively. Then, a pole-like core 16 is inserted into the winding shaft, and a rectangle frame-like core 18 is placed to surround the primary winding 12 and the two secondary windings 14. The pole-like core 16 and rectangle frame-like core 18 are combined to be opposite each other with a gap sheet 20 (see FIG. 2) of the same thickness interposed therebetween at either end. In this way, a two-output inverter transformer is made.

Here, let L1 (constant) be the length along the winding shaft of the rectangle frame-like core, L2 (variable) be the length of the pole-like core, and t (constant) be the thickness of the gap sheet. The relationship between the protrusion amount of the pole-like core and the inductance of the secondary winding was studied. That is, the length L2 of the pole-like core was changed from a state where the pole-like core is recessed into the rectangle frame-like core (FIG. 1A)

to a state where the pole-like core protrudes from the rectangle frame-like core (FIG. 1B).

The main parameters of the cores and the windings were as follows.

Rectangle frame-like core: Length L1=32.10 mm;

Pole-like core: 5.70 mm in width, 3.20 mm in height, Length L2 being variable;

Primary winding: 24 turns;

Secondary windings: 2,200 turns each; and

Gap sheet: 0.15 mm in thickness.

The other detail parameters of the cores and the windings were decided on based on the conventional art so that it took the same preferred shape, and the simulation was performed.

Figure 3:
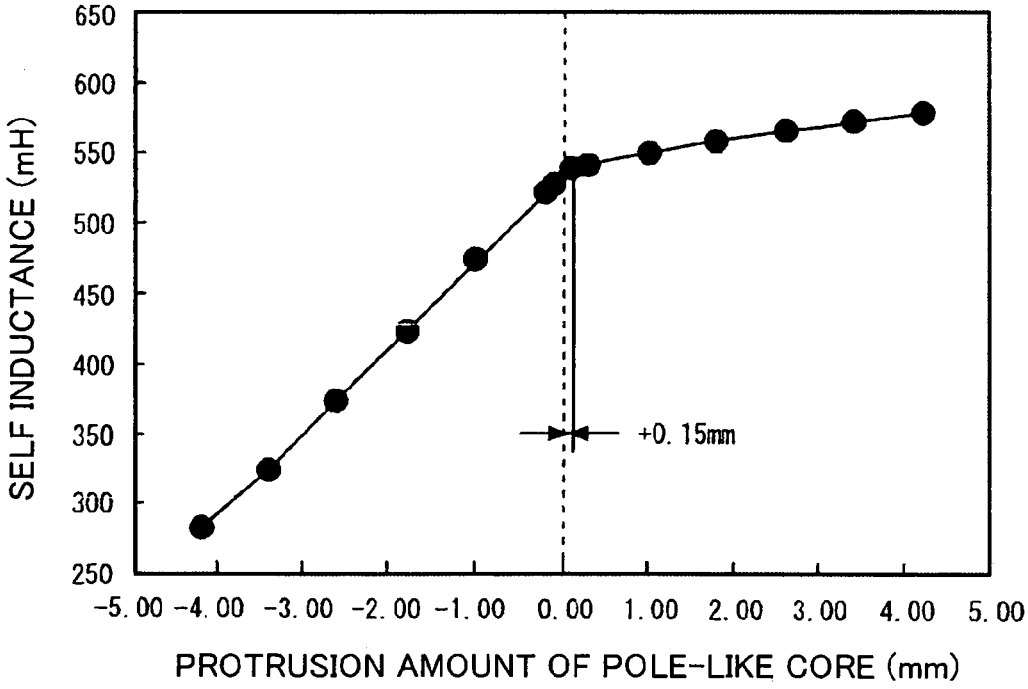
FIG. 3 is a graph showing results of the simulation.

The results are shown in FIG. 3. The horizontal axis of the graph represents the protrusion amount (mm) by which one end of the pole-like core protrudes from the end face of the rectangle frame-like core, and the vertical axis of the graph represents the inductance (mH) of the secondary winding. In FIG. 3, the inductance of one of the secondary windings is shown because the inductances of the secondary windings on both sides are the same. As apparent from FIG. 3, the inductance is substantially linear against the protrusion amount of the pole-like core, but the gradient of the straight line is different between the states where the pole-like core is recessed into the rectangle frame-like core (as a state shown in FIG. 1A) and the states where the pole-like core protrudes (as a state shown in FIG. 1B). The former is steep and the latter is gradual. This is considered to be because the effect of leaking magnetic flux becomes smaller by making the pole-like core protrude by a size greater than the length of the gap, so that variation in the inductance becomes smaller. The intersection of both the straight lines is located at a position where the protrusion amount of the pole-like core is at approximately +0.15 mm. This protrusion amount just corresponds to the thickness t of the gap sheet.

Thus, according to the present invention, when the protrusion amount of the pole-like core on one side is set to be greater than t (=+0.15 mm), even if the sizes of the cores slightly vary or the pole-like core and the rectangle frame-like core deviate slightly in relative position when combined, the lamp currents of a plurality of cold cathode tubes arranged side by side when driven are uniform and thus variation in brightness can be suppressed because the cores are in a region where the inductance varies gradually and linearly. Since the thickness of the gap sheet for such an inverter transformer is usually about 0.10-0.20 mm, the protrusion amount of the pole-like core is decided on correspondingly.

EXAMPLE

Figure 4A:
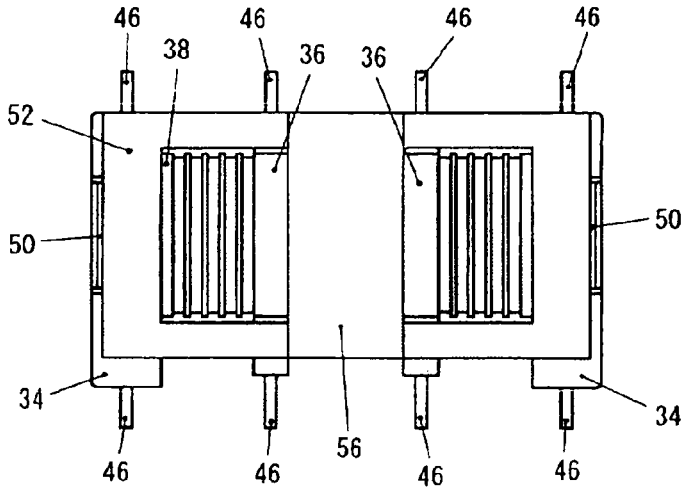
FIG. 4A is a plan view of an example of an inverter transformer according to the present invention.
Figure 4B:
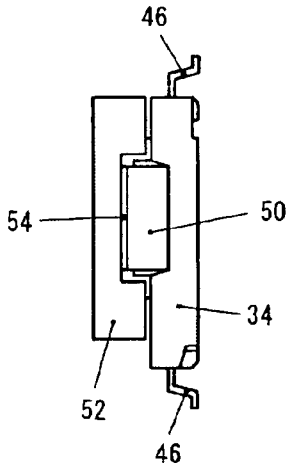
FIG. 4B is a side view of the example of the inverter transformer.
Figure 4C:
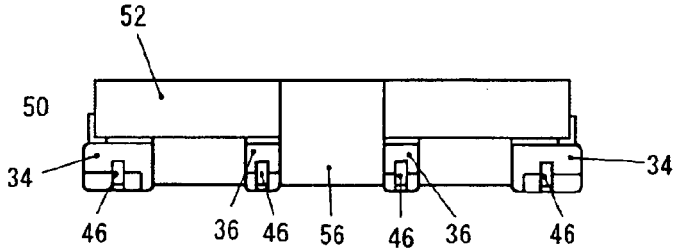
FIG. 4C is a front view of the example of the inverter transformer.
Figure 5A:
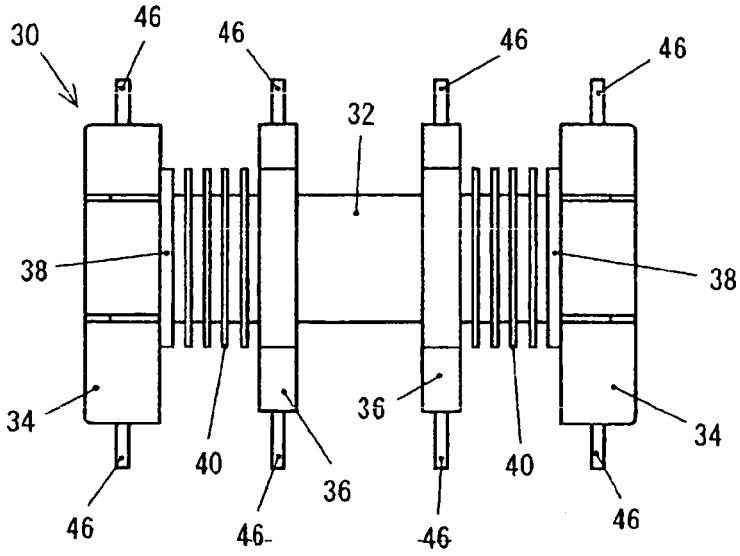
FIG. 5A is a plan view of a bobbin that is used in the inverter transformer according to the present invention.
Figure 5B:
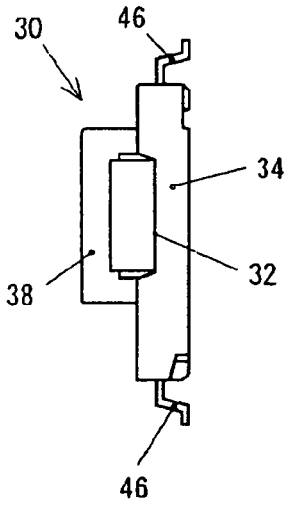
FIG. 5B is a side view of the bobbin that is used in the inverter transformer.
Figure 5C:
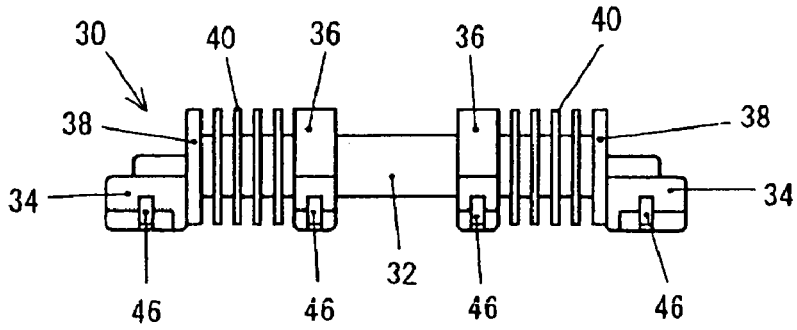
FIG. 5C is a front view of the bobbin that is used in the inverter transformer.
Figure 5D:
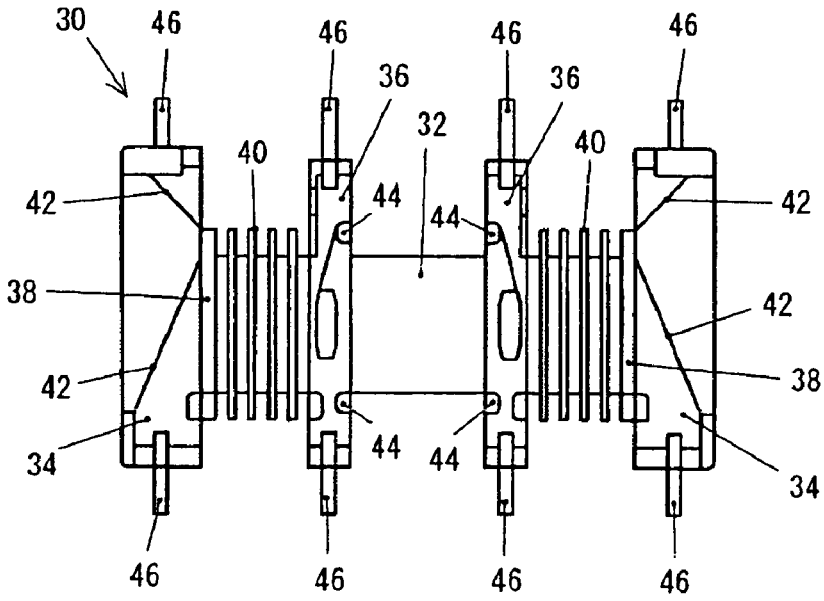
FIG. 5D is a bottom view of the bobbin that is used in the inverter transformer.

FIG. 4 show an example of an inverter transformer according to the present invention. FIG. 4A is a plan view; FIG. 4B is a side view; and FIG. 4C is a front view. FIG. 5 show a bobbin for the inverter transformer. FIG. 5A is a plan view; FIG. 5B is a side view; FIG. 5C is a front view; and FIG. 5D is a bottom view.

As shown in FIGS. 5A-5D, the bobbin 30 has an end block 34 provided at either end of a winding shaft 32 and has two intermediate blocks 36 spaced apart on the middle of the winding shaft, a primary winding being wound between the two intermediate blocks 36, secondary windings of the same winding structure being wound respectively on both sides between the intermediate block 36 and the end block 34. An insulating flange 38 is provided on the inner face of each end block 34 facing one of the secondary windings, and each intermediate block 36 functions as a flange separating the ends of both the windings. Further, portions of the bobbin for the secondary windings are each provided with a plurality of insulating sub-flanges 40. Each secondary winding is wound dividedly around sub-portions partitioned into by the sub-flanges 40. Moreover, pull-out grooves 42 are formed in the bottom of the end block 34 of the bobbin 30, and protrusions 44 are formed on the bottom of the intermediate block 36 to secure a path through which the wire of the primary winding passes, with which the beginnings and ends of the windings are fixed in place, thereby preventing the windings from deviating. This bobbin 30 is integrally formed of electrically insulating resin. With this bobbin structure, the primary winding can be a para-winding, which can deal with a large current. Furthermore, terminals 46 protrude from the opposite sides of each of the end block 34 and the intermediate blocks 36, and the ends of the windings are twisted around the terminals 46 and soldered, thereby completing the connection of the windings. Although the present example shown in FIGS. 4 and 5 is of a surface-mounted type, a structure of a pin type may be used.

A magnetic circuit is formed by a combination of a pole-like core 50 and a rectangle frame-like core 52. Material for the cores may be ferrite such as nickel-contained ferrite, or metal-based magnetic material. The pole-like core 50 is rectangle in sectional view and is sized to be inserted into the winding shaft 32 of the bobbin 30. The rectangle frame-like core 52 is so structured that, when assembled, it surrounds the primary winding and the secondary windings wound around the bobbin 30 and is opposite the pole-like core 50 with a gap sheet 54 interposed therebetween at either end of the bobbin 30. By winding insulating tape 56 around the primary winding wound, the bobbin 30 and the rectangle frame-like core 52 aligned with each other are attached on a temporary basis. By this means, the pole-like core 50 and the rectangle frame-like core 52 can be combined easily and accurately.

The pole-like core 50 is sized to protrude by greater than the gap length evenly from both end faces of the rectangle frame-like core 52. The pole-like core 50, the rectangle frame-like core 52, and the bobbin 30 are aligned with each other and fixed with adhesive or the like.

Further, as mentioned above, when by winding the insulating tape 56 around the primary winding wound, the bobbin 30 and the rectangle frame-like core 52 aligned with each other are attached on a temporary basis, the upper surface of the transformer is smooth with the insulating tape 56 and thus can be used as a sucking-attachment surface in mounting the transformer.

What is claimed is:

1. A two-output inverter transformer comprising:

a bobbin that has a winding shaft, an end block provided at either end of the winding shaft, two intermediate blocks spaced apart on the middle of the winding shaft, a portion between the two intermediate blocks around which a primary winding is wound, and portions on both sides of the primary winding portion between the intermediate block and the end block around which secondary windings of the same winding structure are wound respectively;

a pole-like core inserted into the winding shaft;

a rectangle frame-like core combined with the pole-like core and placed to surround the primary winding and the secondary windings; and gap sheets of the same thickness interposed between the pole-like core and the rectangle frame-like core at both ends of the bobbin respectively, wherein L1, L2, and t are set such that L2−L1>2 t, where L1 is the length along the winding shaft of the rectangle frame-like core, L2 is the length of the pole-like core, and t is the thickness of the gap sheet, and wherein the pole-like core and the rectangle frame-like core are so combined that the pole-like core protrudes evenly from the opposite end faces of the rectangle frame-like core.

2. The inverter transformer according to claim 1, wherein the bobbin has an insulating flange provided on the inner face of each of the end blocks facing one of the secondary winding portions; the intermediate blocks each function as a flange; the secondary winding portions are each provided with a plurality of sub-flanges around which the secondary winding is wound dividedly; and terminals to which the ends of the windings are connected are fixed to two or more of the blocks.

3. The inverter transformer according to claim 1, wherein by winding insulating tape around the primary winding wound around the primary winding portion, the bobbin and the rectangle frame-like core aligned with each other are attached on a temporary basis.

4. The inverter transformer according to claim 1, wherein pull-out grooves for the secondary windings and a protrusion to secure a path through which the wire of the primary winding passes are formed in and on one or more of the blocks of the bobbin.

* * * * *